US012781977B2

(12) United States Patent
Yun et al.

(10) Patent No.: US 12,781,977 B2
(45) Date of Patent: Nov. 3, 2026

(54) HEAT EXCHANGER ASSEMBLY AND OUTDOOR UNIT COMPRISING HEAT EXCHANGER ASSEMBLY

(71) Applicant: Samsung Electronics Co., Ltd., Suwon-si (KR)

(72) Inventors: Seungjin Yun, Suwon-si (KR); Jeonguk Koh, Suwon-si (KR); Junggeon Kim, Suwon-si (KR); Kwangdeuk Park, Suwon-si (KR); Woong Sun, Suwon-si (KR); Yongjae Song, Suwon-si (KR); Kwangnam Shin, Suwon-si (KR); Changsoo Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 24 days.

(21) Appl. No.: 18/671,355

(22) Filed: May 22, 2024

(65) Prior Publication Data

US 2024/0310059 A1 Sep. 19, 2024

Related U.S. Application Data

(63) Continuation of application No. PCT/KR2022/014619, filed on Sep. 29, 2022.

(30) Foreign Application Priority Data

Nov. 22, 2021 (KR) ..... 10-2021-0161718

(51) Int. Cl.
*F24F 1/16* (2011.01)
*F24F 1/08* (2011.01)
(Continued)

(52) U.S. Cl.
CPC ..... *F24F 1/16* (2013.01); *F24F 1/08* (2013.01); *F24F 1/46* (2013.01); *F25B 40/02* (2013.01)

(58) Field of Classification Search
CPC ..... F24F 1/16; F24F 1/08; F24F 1/46; F24F 1/12; F25B 40/02; F25B 41/31
See application file for complete search history.

(56) References Cited

U.S. PATENT DOCUMENTS 9,810,457 B2 11/2017 Park et al.
10,935,288 B2 3/2021 Rhee et al.
(Continued)

FOREIGN PATENT DOCUMENTS

CN 101165436 4/2008
DE 102011007701 A1 * 10/2012 ..... F25B 39/04
(Continued)

OTHER PUBLICATIONS

DE 102011007701 A1 Translation (Year: 2012).*
(Continued)

*Primary Examiner* — Jerry-Daryl Fletcher
*Assistant Examiner* — Dario Antonio Deleon
(74) *Attorney, Agent, or Firm* — Nixon & Vanderhye P.C.

(57) ABSTRACT

A heat exchanger assembly according to an example includes: a compressor configured to compress a refrigerant, a first heat exchanger configured to exchange heat between the refrigerant and a liquid, a subcooler configured to subcool the refrigerant, and a base supporting the compressor and the first heat exchanger, wherein the subcooler is supported on a side of the first heat exchanger.

11 Claims, 13 Drawing Sheets

(51) Int. Cl.
*F24F 1/46* (2011.01)
*F25B 40/02* (2006.01)

(56) References Cited

U.S. PATENT DOCUMENTS

| | | | | |
|---|---|---|---|---|
| 2002/0029877 | A1* | 3/2002 | Cowans | F25B 5/02 165/206 |
| 2008/0053142 | A1 | 3/2008 | Shin et al. | |
| 2008/0087031 | A1 | 4/2008 | Park et al. | |
| 2008/0314068 | A1 | 12/2008 | Jang et al. | |
| 2020/0340688 | A1* | 10/2020 | Chung et al. | F24F 1/10 |

FOREIGN PATENT DOCUMENTS

| | | | | |
|---|---|---|---|---|
| EP | 1862743 | A1 | 12/2007 | |
| EP | 1959204 | | 8/2008 | |
| JP | 1959204 | A1 * | 8/2008 | F24F 1/12 |
| JP | 2020060353 | A | 4/2020 | |
| JP | 2021055972 | A | 4/2021 | |
| KR | 20030000208 | A | 1/2003 | |
| KR | 100505236 | B1 | 8/2005 | |
| KR | 10-2008-0020766 | A | 3/2008 | |
| KR | 100875904 | B1 | 12/2008 | |
| KR | 20090028064 | A | 3/2009 | |
| KR | 100941604 | B1 | 2/2010 | |
| KR | 20100036789 | A | 4/2010 | |
| KR | 10-2010-0081850 | | 7/2010 | |
| KR | 20100084858 | A | 7/2010 | |
| KR | 101319654 | B1 * | 10/2013 | F24F 13/32 |
| KR | 20200001019 | A | 1/2020 | |
| KR | 102203436 | B1 | 1/2021 | |
| KR | 102477289 | B1 | 12/2022 | |
| WO | 2020/261734 | | 12/2020 | |

OTHER PUBLICATIONS

EP 1959204 A1 Translation (Year: 2008).*
KR 101319654 B1 Translation (Year: 2013).*
International Search Report and Written Opinion of the ISA for PCT/KR2022/014619 mailed Jan. 10, 2023, 13 pages (with English Translation).
Extended European Search Report dated Nov. 25, 2024 issued in European Patent Application No. 22895839.3.
Korean Office Action dated Apr. 28, 2026 for KR Application No. 10-2021-0161718.
European Office Action dated Jul. 24, 2026 for EP Application No. 22895839.3.

* cited by examiner

HEAT EXCHANGER ASSEMBLY AND OUTDOOR UNIT COMPRISING HEAT EXCHANGER ASSEMBLY

CROSS-REFERENCE TO RELATED APPLICATIONS

This application is a continuation of International Application PCT/KR2022/014619 designating the United States, filed on Sep. 29, 2022, in the Korean Intellectual Property Receiving Office and claiming priority to Korean Patent Application No. 10-2021-0161718, filed on Nov. 22, 2021, in the Korean Intellectual Property Office, the disclosures of each of which are incorporated by reference herein in their entireties.

BACKGROUND

Field

The disclosure relates to a heat exchanger assembly and an outdoor unit including the heat exchanger assembly.

Description of Related Art

A heat exchanger apparatus for exchanging heat between air and a liquid such as water through a refrigerant by connecting a compressor, an air heat exchanger, an expander, and a liquid heat exchanger using a liquid such as water, and an air conditioner including the heat exchanger apparatus have been widely used. There may be limits to the amount of refrigerants allowed in air conditioners due to issues such as environmental protection or cost. However, because it is difficult to reduce the length of the refrigerant pipe through which the refrigerant flows, a design that reduces the diameter of the refrigerant pipe can be applied instead.

In the case in which the diameter of the refrigerant pipe is reduced, the pressure drop of the refrigerant within the refrigerant pipe relatively increases. This may cause the refrigerant, which needs to be a liquid at a section where the refrigerant enters the expander, to change to a two-phase state. To maintain the refrigerant transferred to the expander in a liquid state, a subcooler may be arranged for additionally cooling the refrigerant. The location of the subcooler may be set in consideration of the circulation cycle of the refrigerant and the path of the refrigerant pipe.

SUMMARY

Embodiments of the disclosure provide a heat exchanger assembly capable of reducing a vibration excitation force by a compressor generating vibrations because a subcooler is supported on a side of a first heat exchanger to reduce a vibration displacement amount of a base portion on which the compressor is supported, and an outdoor unit including the heat exchanger assembly.

Embodiments of the disclosure provide a heat exchanger assembly in which a subcooler and a first heat exchanger can be independently separated and replaced, and an outdoor unit including the heat exchanger assembly.

A heat exchanger assembly according to an example embodiment may include: a compressor configured to compress a refrigerant, a first heat exchanger configured to exchange heat between the refrigerant and a liquid, a subcooler configured to subcool the refrigerant, and a base supporting the compressor and the first heat exchanger, wherein the subcooler may be supported on a side of the first heat exchanger.

The heat exchanger assembly may further include a first support structure including a support configured to support the first heat exchanger on the base portion.

The heat exchanger assembly may further include a second support structure comprising a support configured to support the subcooler on the first heat exchanger, wherein the second support structure may be connected to the first support structure.

The first support structure may include a first bracket positioned on a first side of the first heat exchanger, a first coupling portion configured to fix the first bracket to the first side and the base portion, a second first bracket positioned on a second side opposite to the first side, and a second first coupling portion configured to fix the second first bracket to the second side and the base portion, wherein the second support structure may include a second bracket supporting one or more surfaces of the subcooler, a first second coupling portion configured to fix the first bracket to an end portion of the second bracket, and a second coupling portion configured to fix the second first bracket to another end portion of the second bracket.

The first second coupling portion may include one or more among a hook or a screw.

The second coupling portion may include one or more among a hook or a screw.

The second first bracket may be supported on the base portion to be detachable from the base portion.

The subcooler may be supported on the first side and another side vertical to the first side.

The second bracket may be supported on the first bracket and the second first bracket to be detachable from the first bracket and the second first bracket.

The subcooler may be arranged to be spaced a specified distance from the base portion.

An outdoor unit including a heat exchanger assembly according to an example embodiment may include: a compressor configured to compress a refrigerant, a first heat exchanger configured to exchange heat between the refrigerant and a liquid, a second heat exchanger configured to exchange heat between the refrigerant and air or a liquid, a subcooler configured to subcool the refrigerant, one or more expanders configured to expand the refrigerant transferred through the subcooler, and a base supporting the compressor and the first heat exchanger, wherein the subcooler may be supported on a side of the first heat exchanger.

The outdoor unit may further include a first support structure comprising a support supporting the first heat exchanger on the base portion.

The outdoor unit may further include a second support structure comprising a support supporting the subcooler on the first heat exchanger, wherein the second support structure may be arranged to be connected to the first support structure.

The first support structure may include a first bracket positioned on a first side of the first heat exchanger, a first coupling portion configured to fix the first bracket to the first side and the base portion, a second first bracket positioned on a second side opposite to the first side, and a second first coupling portion configured to fix the second first bracket to the second side and the base portion, and the second support structure may include a second bracket supporting one or more surfaces of the subcooler, a first second coupling portion configured to fix the first bracket to an end portion of the second bracket, and a second coupling portion configured to fix the second first bracket to another end portion of the second bracket.

The first second coupling portion may include one or more among a hook or a screw.

The second coupling portion may include one or more among a hook or a screw.

The second first bracket may be supported on the base portion to be detachable from the base portion.

The subcooler may be supported on the first side and another side vertical to the first side.

The second bracket may be supported on the first bracket and the second first bracket to be detachable from the first bracket and the second first bracket.

The subcooler may be arranged to be spaced a specified distance from the base portion.

According to an example embodiment of the present disclosure, a heat exchanger assembly capable of reducing a vibration excitation force by a compressor generating vibrations because a subcooler is supported on a side of a first heat exchanger to reduce a vibration displacement amount of a base portion on which the compressor is supported, and an outdoor unit including the heat exchanger assembly may be provided.

According to an example embodiment of the present disclosure, because the subcooler is independently separated and replaced with respect to the first heat exchanger, ease of use may be improved.

According to an example embodiment of the present disclosure, because the first heat exchanger is independently separated and replaced with respect to the subcooler, ease of use may be improved.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1A:
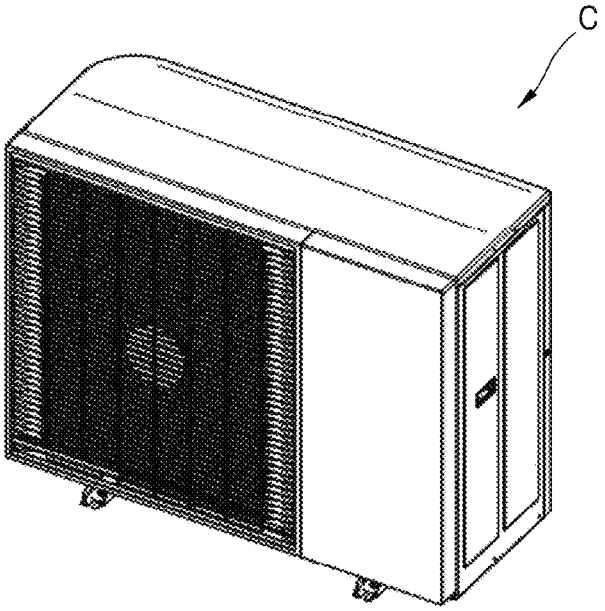
FIG. 1A is a front perspective view of an outdoor unit including a heat exchanger assembly according to various embodiments.

Hereinafter, an example configuration and operations of the disclosure will be described in greater detail through various example embodiments of the accompanying drawings.

Terms used in this disclosure will be briefly described, and the disclosure will be described in greater detail.

Although general terms that are currently widely used were selected as terminology used in the disclosure while considering the functions of the disclosure, they may vary according to intentions of one of ordinary skill in the art, judicial precedents, the advent of new technologies, and the like. Terms arbitrarily selected may also be used in a specific case. In this case, their meanings will be described in detail in the detailed description of the disclosure. Hence, the terms must be defined based on the meanings of the terms and the contents of the entire disclosure, not by simply stating the terms themselves.

It will be understood that when a certain part "comprises" or "includes" a certain component, the part does not exclude another component but can further include another component, unless the context clearly dictates otherwise.

Also, the terms "first", "second", etc. do not have limited meanings, and are merely used to distinguish one component from another.

Hereinafter, various example embodiments of the disclosure will be described in greater detail with reference to the accompanying drawings. The disclosure may, however, be embodied in many different forms and should not be construed as being limited to the embodiments set forth herein. In the drawings, portions that are irrelevant to the descriptions may be not shown in order to clarify the disclosure, and throughout the disclosure, similar portions are assigned similar reference numerals.

Meanwhile, in the following description, the terms "upper", "lower", "front-rear direction", etc. are defined based on the drawings, and the shapes and positions of the components are not limited by the terms.

Hereinafter, various example embodiments of the disclosure will be described in greater detail with reference to the accompanying drawings.

Figure 1B:
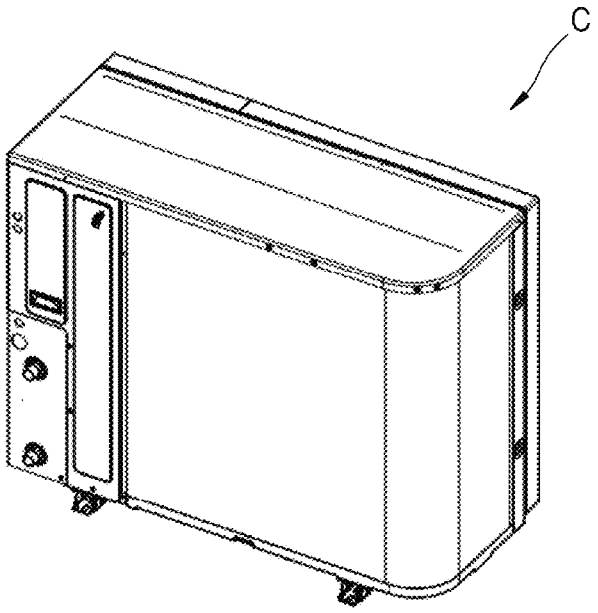
FIG. 1B is a rear perspective view of an outdoor unit including a heat exchanger assembly according to various embodiments.
Figure 2:
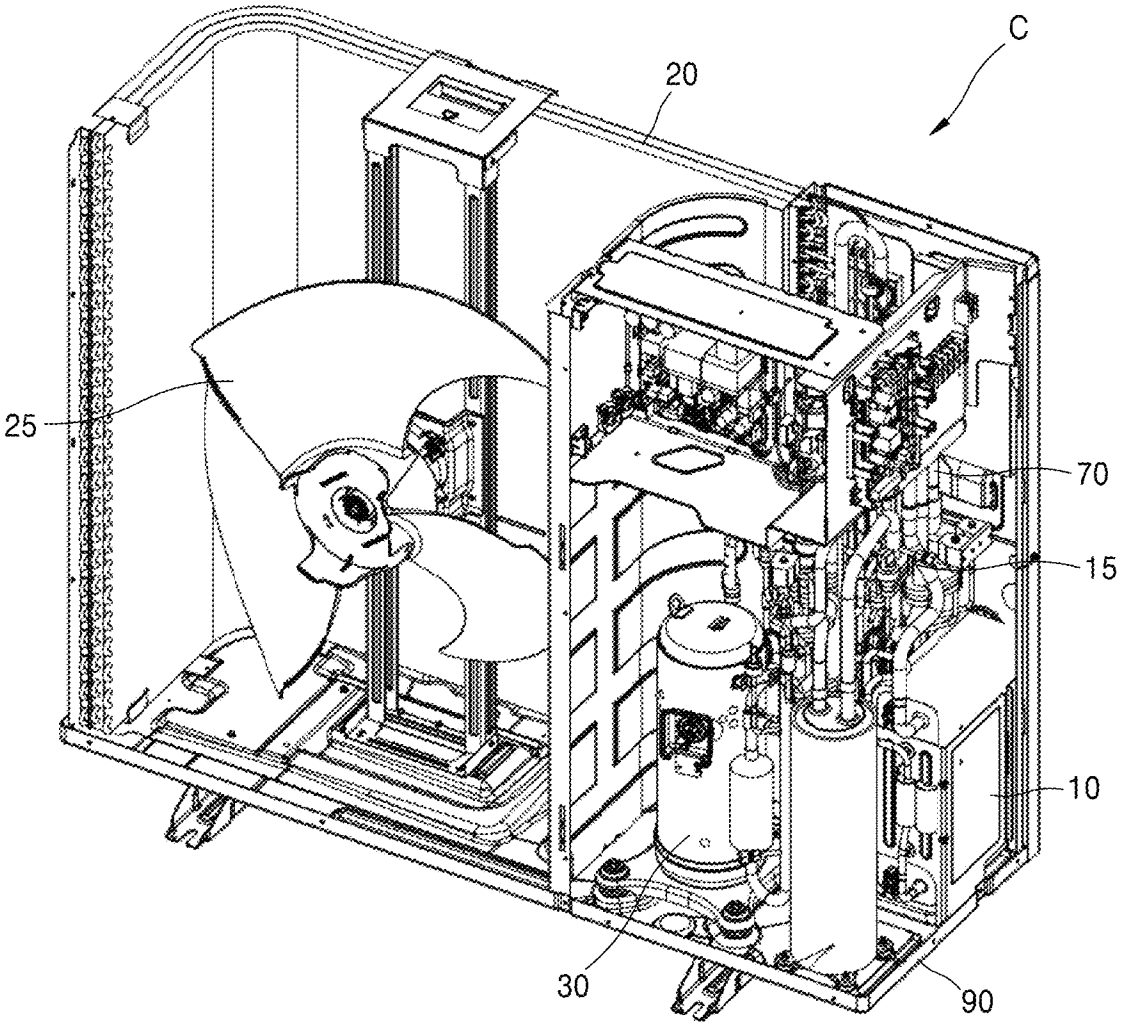
FIG. 2 is a cutaway perspective view of an outdoor unit including a heat exchanger assembly according to various embodiments
Figure 3:
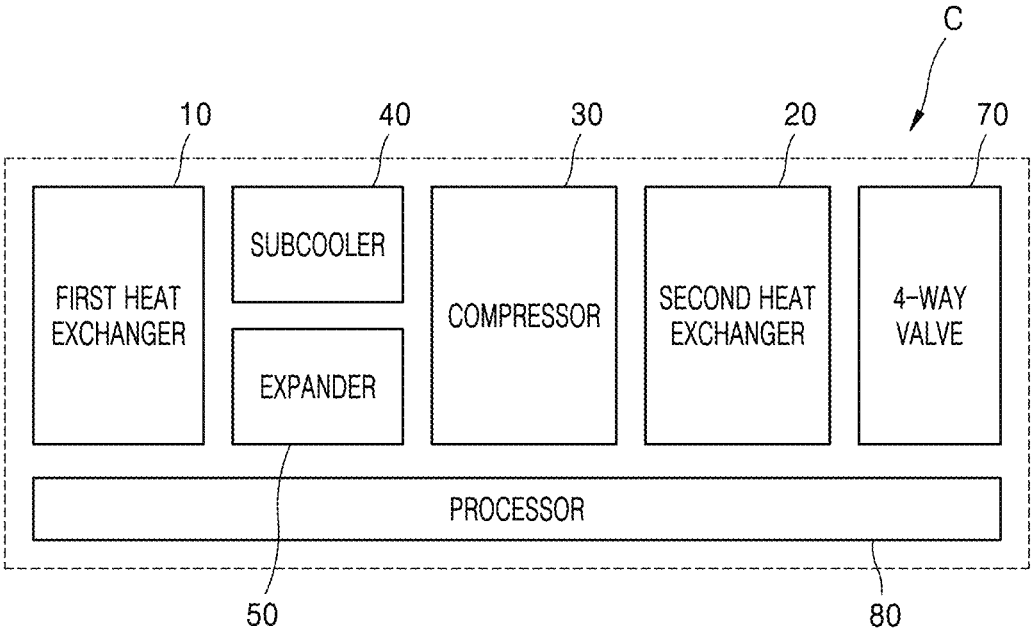
FIG. 3 is a block diagram illustrating an example configuration of an outdoor unit including a heat exchanger assembly according to various embodiments.

FIG. 1A is a front perspective view of an outdoor unit including a heat exchanger assembly according to various embodiments. FIG. 1B is a rear perspective view of an outdoor unit including a heat exchanger assembly according to various embodiments. FIG. 2 is a cutaway perspective view of an outdoor unit including a heat exchanger assembly according to various embodiments. FIG. 3 is a block diagram illustrating an example configuration of an outdoor unit including a heat exchanger assembly according to various embodiments.

Referring to FIGS. 1A, 1B, 2 and 3, an outdoor unit C including a heat exchanger assembly according to an example may be used as an outdoor unit of an air conditioning apparatus, for example, an air conditioner. Also, the outdoor unit C including the heat exchanger assembly according to an example may be used as a heat pump. The outdoor unit C including the heat exchanger assembly according to an example may include a first heat exchanger 10, a second heat exchanger 20, a compressor 30, a subcooler 40, one or more expanders 50, a four-way valve 70, a processor (e.g., including processing circuitry) 80, and a base portion 90.

The first heat exchanger 10 may include a water piping heat exchanger that exchanges heat between a refrigerant and a liquid such as water. As an example, the liquid may be an antifreeze solution such as glycerin, instead of water. Herein, for the sake of illustration, it is assumed that the liquid is water. In the first heat exchanger 10 according to an example, a path through which a refrigerant flows may be adjacent to a path through which water flows. Accordingly, heat may be exchanged between the refrigerant and the water. The first heat exchanger 10 may be a plate (flat plate) type heat exchanger. For example, the plate type heat exchanger may use a thin plate made of stainless steel, titanium, etc., as a heat transfer plate. In this case, a plurality of heat transfer plates may be stacked and fixed by brazing.

The second heat exchanger 20 may be an air-cooled heat exchanger that exchanges heat between air and a refrigerant. In a case in which the second heat exchanger 20 is an air-cooled heat exchanger, a refrigerant may flow inside the second heat exchanger 20 to exchange heat with air. As an example, the second heat exchanger 20 may function as a condenser when cooling water entered the first heat exchanger 10 and as an evaporator when heating water. In the case in which the second heat exchanger 20 is an air-cooled heat exchanger, a fan 25 for blowing air may be positioned in the second heat exchanger 20. An air flow formed by the fan 25 may facilitate heat exchange of the second heat exchanger 20 that is an air-cooled type.

In the current example, for convenience of description, a water piping heat exchanger may be used as an example of the first heat exchanger 10, and an air-cooled heat exchanger may be used as an example of the second heat exchanger 20. In this case, a refrigerant pipe 15 for circulating a refrigerant may be positioned between the first heat exchanger 10 and the second heat exchanger 20. The refrigerant may be, for example, chlorofluorocarbon (freon) having a low boiling point, although the disclosure is not limited thereto.

The compressor 30 may be connected to the refrigerant pipe 15 for circulating the refrigerant to compress the refrigerant. For example, the compressor 30 may compress a gaseous cold refrigerant transferred from the refrigerant pipe 15 to adjust the refrigerant to a high-temperature and high-pressure gaseous state. Because the compressor 30 compresses the refrigerant, a phase change to a liquid state at high temperature may be easily performed. Also, the compressor 30 may provide the refrigerant with a force for forming a circulation cycle by sucking-in a low-pressure refrigerant and discharging a high-pressure refrigerant.

The subcooler 40 may additionally cool a refrigerant transferred to the expander 50 such that the refrigerant is maintained in a liquid state. There may be a limit to an amount of refrigerant allowed in an air conditioner due to issues such as environmental protection or cost. However, because it is difficult to reduce a length of the refrigerant pipe 15 through which a refrigerant flows, a design that reduces a diameter of the refrigerant pipe 15 may be applied instead. In this case, as a result of reducing the diameter of the refrigerant pipe 15, a pressure drop of a refrigerant within the refrigerant pipe 15 may relatively increase. This may cause a refrigerant which needs to be a liquid at a section where the refrigerant enters the expander 50 to change to a two-phase state. Accordingly, a density of the refrigerant entering the expander 50 may be reduced, and as a result, a flow rate of the refrigerant passing through the expander 50 may be reduced. Also, due to a collision of a liquid refrigerant and a gaseous refrigerant, noise and vibrations may be generated in the expander 50. The subcooler 40 according to an embodiment may subcool the refrigerant transferred to the expander 50 by additionally cooling the refrigerant to maintain the refrigerant in a liquid state.

The expander 50 may expand the refrigerant transferred through the subcooler 40. For example, the expander 50 may be one or more expansion valves. For example, the expander 50 may pass the refrigerant through a path having a relatively small diameter to lower the pressure of the refrigerant, thereby causing the refrigerant to be easily evaporated later.

The four-way valve 70 may change a path of the refrigerant to correspond to any one of a cooling mode and a heating mode. The four-way valve 70 may switch operations of an indoor heat exchanger and an outdoor heat exchanger according to a mode by adjusting a movement of the refrigerant to correspond to a current mode.

The processor 80 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions. The processor 80 may, for example, control and direct operations of structures including the above-described components. For example, the processor 80 may be implemented as hardware, such as a central processing unit (CPU), a micro-processor, a chipset, or a system-on-chip (SOC), mounted on a printed circuit board.

The base portion 90 may be a plate-shaped supporter extending along one plane. The base portion 90 according to an example may support the above-described components, for example, the first heat exchanger 10 and the compressor 30. For example, while the compressor 30 operates, vibrations generated from the compressor 30 may be transferred to all the above-described components through the base portion 90. An increase of a mass of other components supported on the base portion 90 together with the compressor 30 may reduce a vibration displacement amount of the base portion 90 on which the compressor 30 is supported, thereby reducing a vibration excitation force by the compressor 30.

Hereinafter, a heat exchanger assembly 1 including the first heat exchanger 10 and the compressor 30 supported on the base portion 90, and the subcooler 40 supported on a side of the first heat exchanger 10 to reduce a vibration excitation force generated from the compressor 30, will be described in greater detail.

Figure 4:
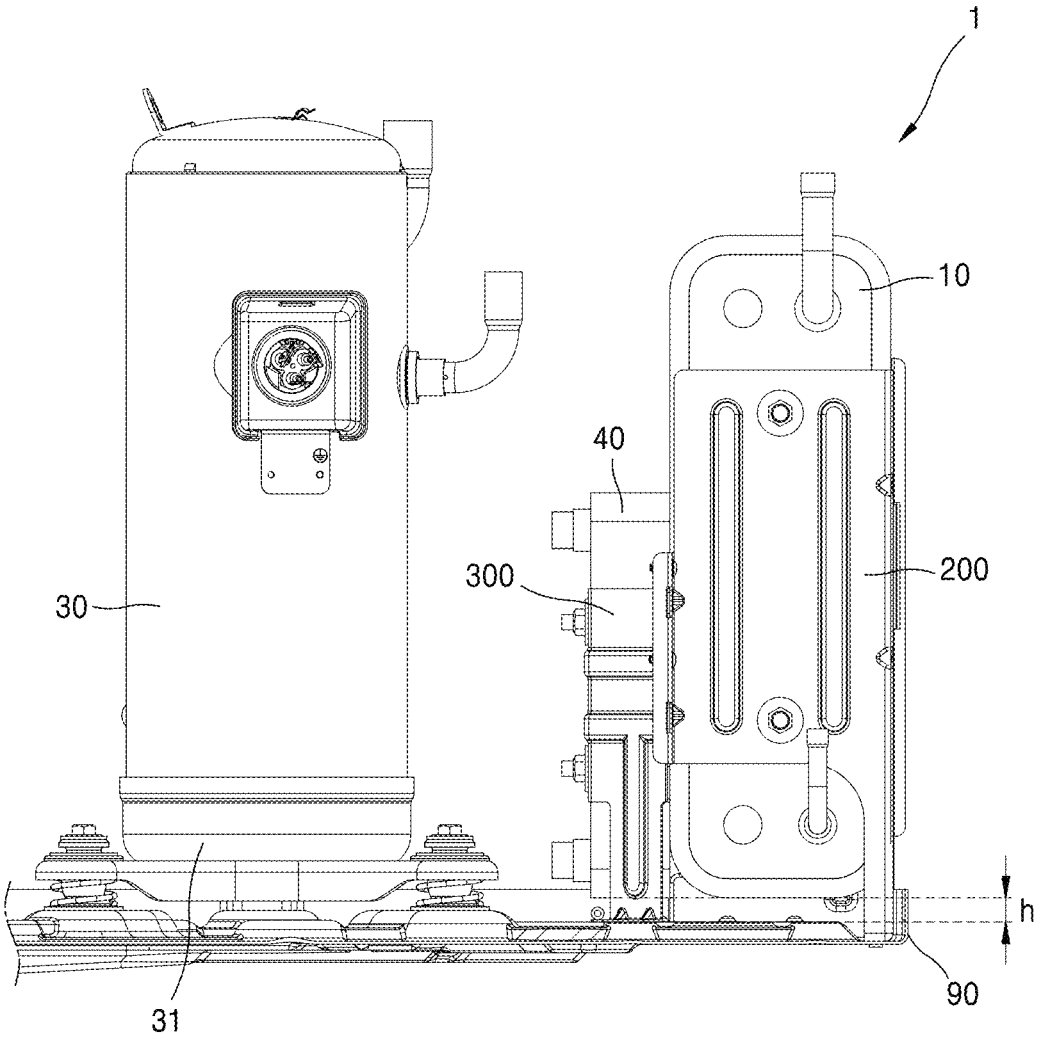
FIG. 4 is a perspective view of a heat exchanger assembly according to various embodiments.
Figure 5:
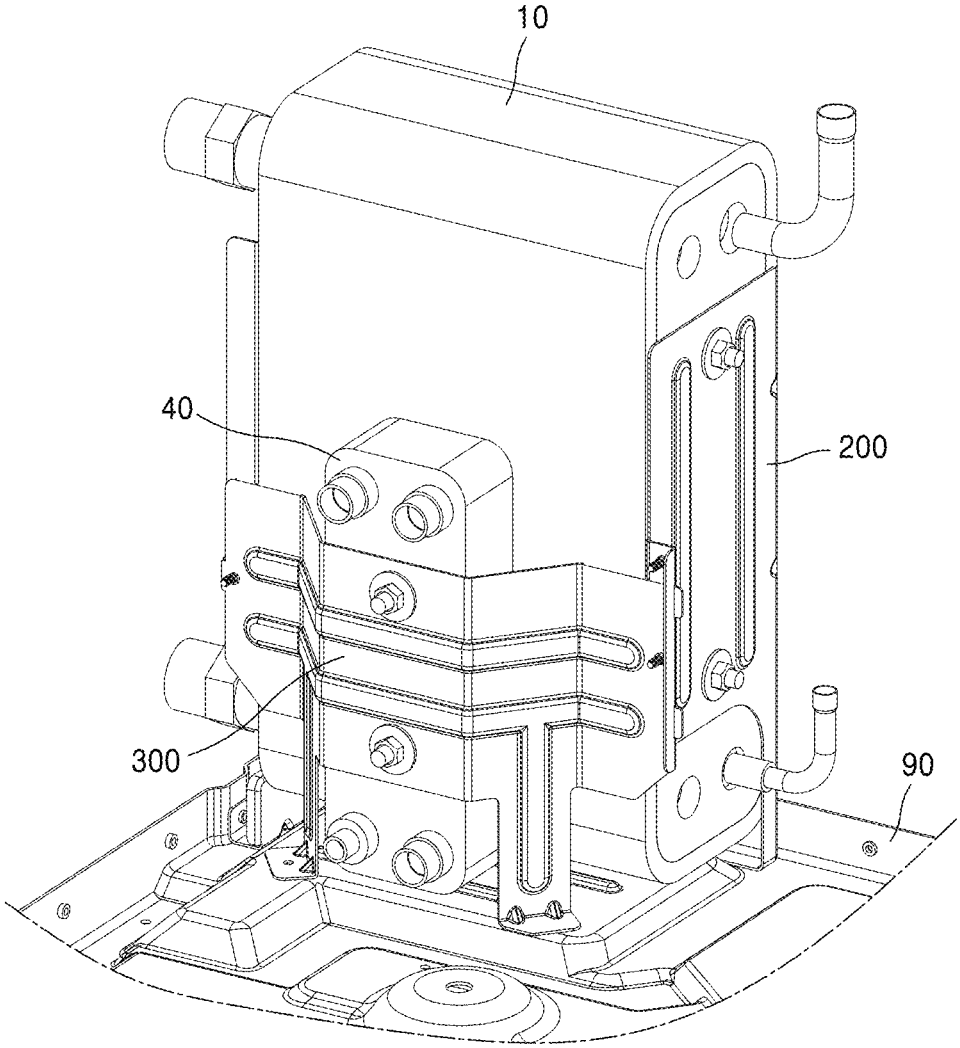
FIG. 5 is a perspective view of a first heat exchanger, a subcooler, a first support structure, a second support structure, and a base portion, according to various embodiments.
Figure 6:
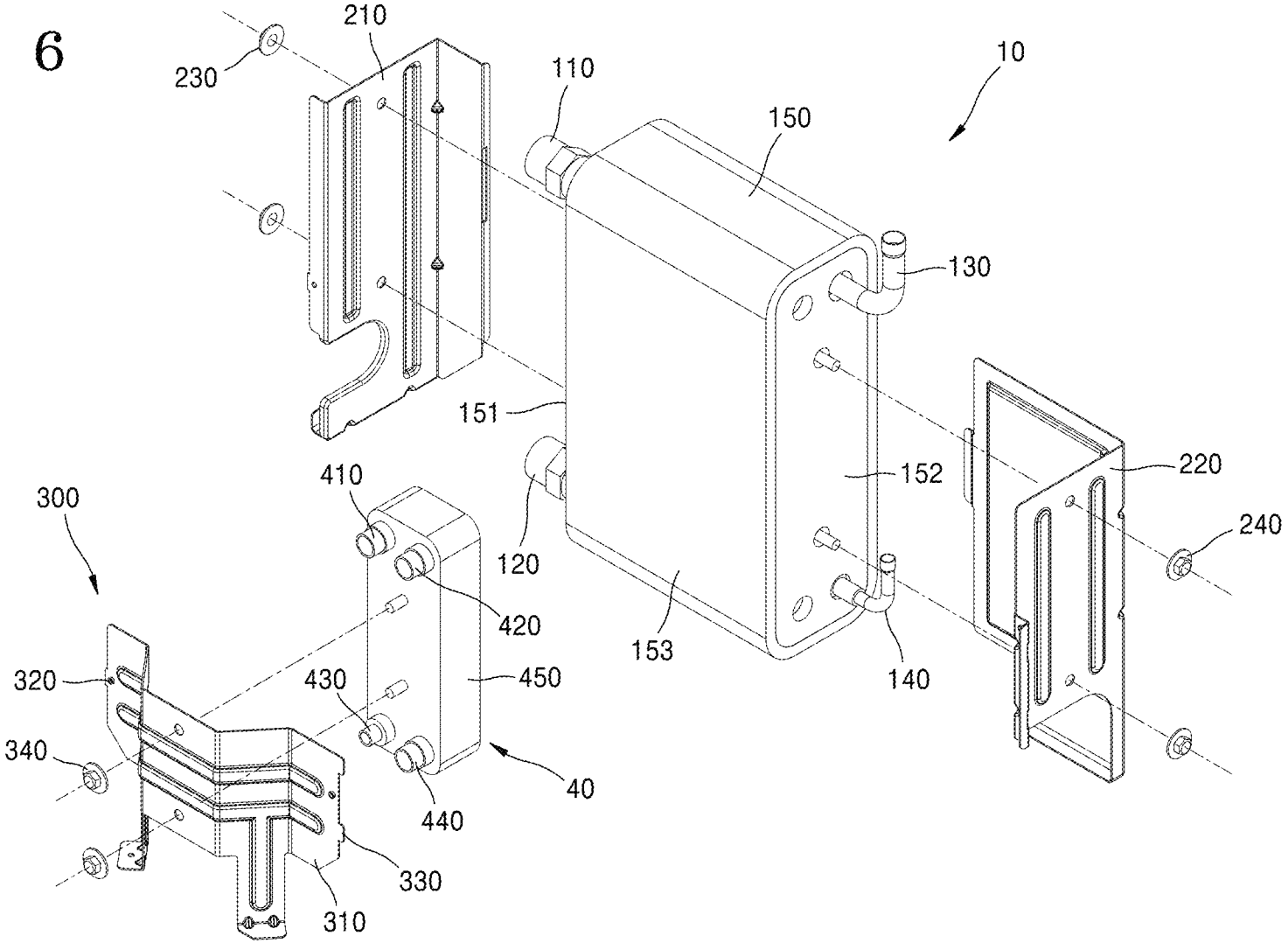
FIG. 6 is an exploded perspective view of a first heat exchanger, a subcooler, a first support structure, and a second support structure, according to various embodiments.
Figure 7A:
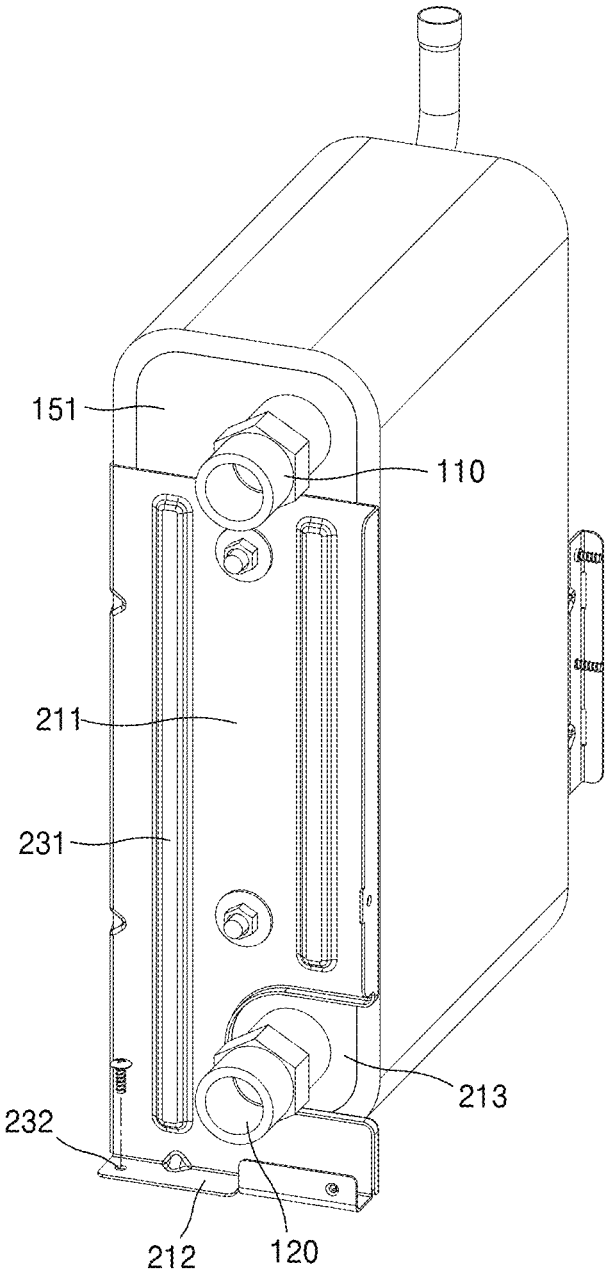
FIG. 7A is a perspective view of a first heat exchanger supported on a first support structure, according to various embodiments.
Figure 7B:
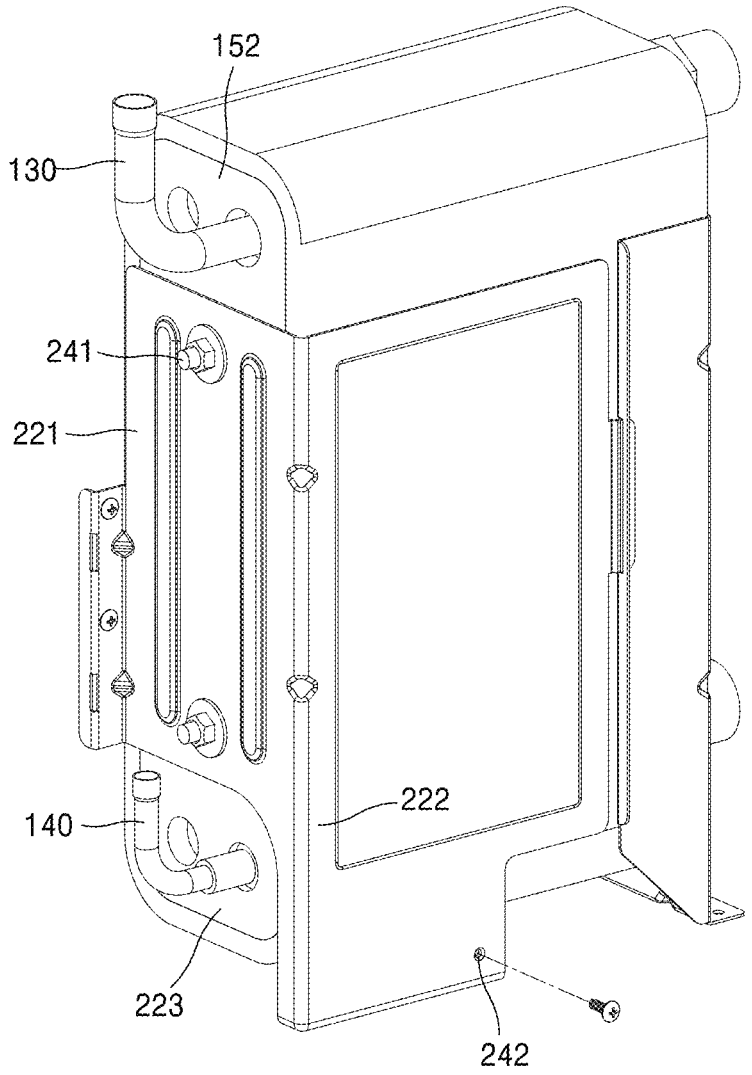
FIG. 7B is a perspective view of a first heat exchanger supported on a first support structure, according to various embodiments.
Figure 8:
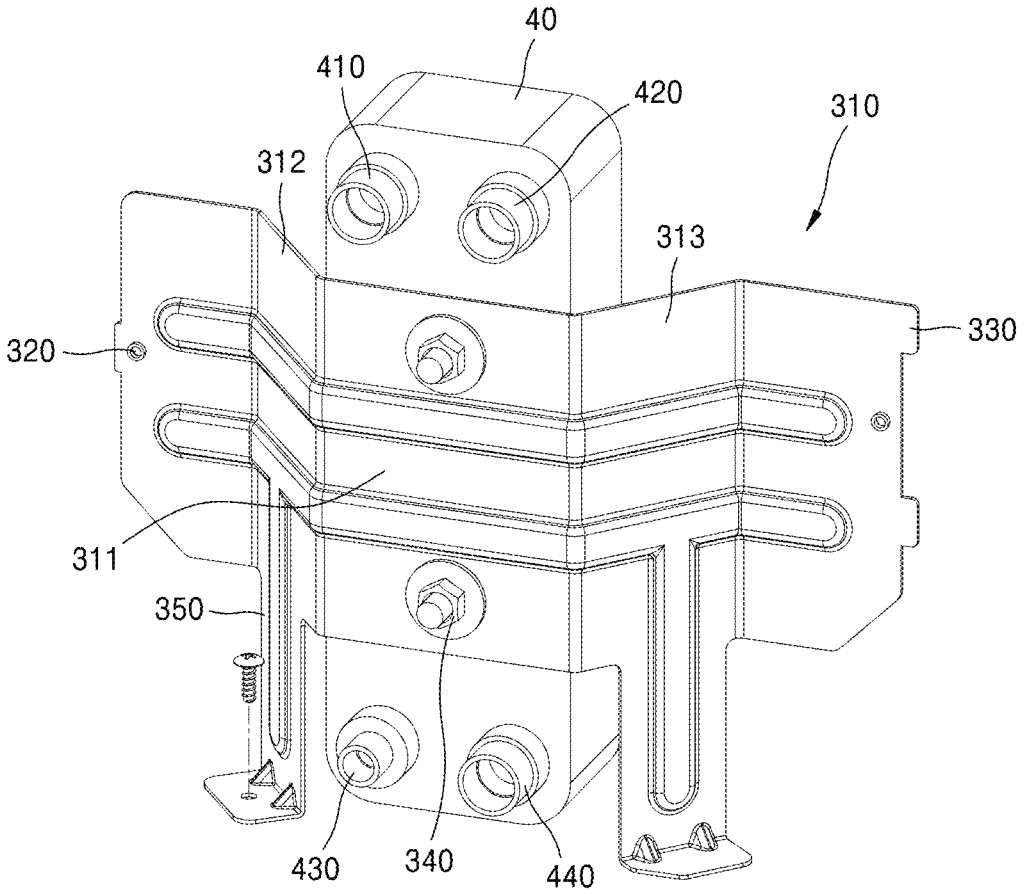
FIG. 8 is a perspective view of a subcooler supported on a second support structure, according to various embodiments.
Figure 9:
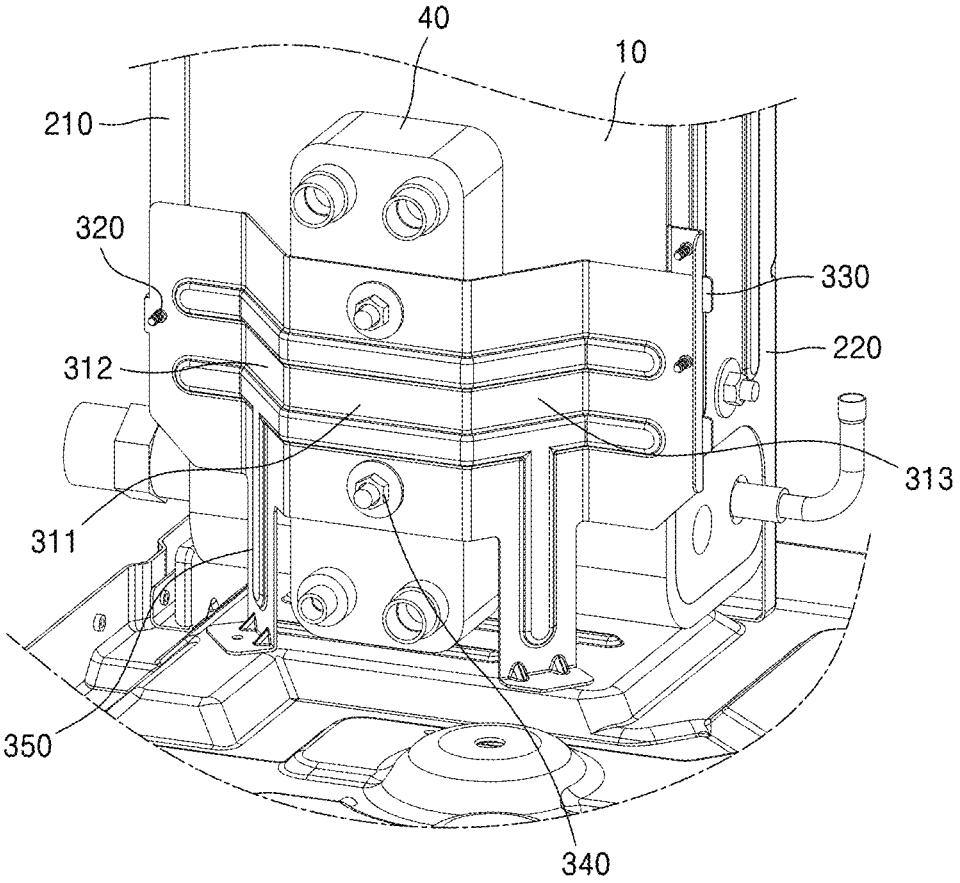
FIG. 9 is a partial perspective view of a heat exchanger assembly in which a first support structure is coupled to a second support structure, according to various embodiments.

FIG. 4 is a perspective view of a heat exchanger assembly according to various embodiments. FIG. 5 is a perspective view of a first heat exchanger, a subcooler, a first support structure, a second support structure, and a base portion, according to various embodiments. FIG. 6 is an exploded perspective view of a first heat exchanger, a subcooler, a first support structure, and a second support structure, according to various embodiments. FIG. 7A is a perspective view of a first heat exchanger supported on a first support structure, according to various embodiments. FIG. 7B is a perspective view of a first heat exchanger supported on a first support structure, according to various embodiments. FIG. 8 is a perspective view of a subcooler supported on a second support structure, according to various embodiments. FIG. 9 is a partial perspective view of a heat exchanger assembly in which a first support structure is coupled to a second support structure, according to various embodiments.

Referring to FIGS. 4, 5 and 6, the heat exchanger assembly 1 according to an example may include the first heat exchanger 10, the compressor 30, the subcooler 40, the base portion 90, a first support structure 200 and a second support structure 300. The first heat exchanger 10 may be a plate (flat plate) type heat exchanger, as described above. For example, the first heat exchanger 10 may include a first housing 150 that is in a shape of a rectangular parallelepiped capable of accommodating stacked heat transfer plates (not shown). However, the disclosure is not limited to this, and the first housing 150 may have an arbitrary shape depending on a shape of a heat transfer plate accommodated therein.

As an example, the first heat exchanger 10 may be a water piping heat exchanger that exchanges heat between a refrigerant and a liquid such as water, as described above. For example, the first heat exchanger 10 may include a 1-1 inlet pipe 110 and a 1-1 outlet pipe 120 through which a liquid flows in and out. Also, the first heat exchanger 10 may include a 1-2 inlet pipe 130 and a 1-2 outlet pipe 140 through which a liquid flows in and out. For example, the 1-1 inlet pipe 110 and the 1-1 outlet pipe 120 may be positioned at a first side 151, and the 1-2 inlet pipe 130 and the 1-2 outlet pipe 140 may be positioned at a second side 152 that is opposite to the first side 151. However, the disclosure is not limited to this, and the 1-1 inlet pipe 110 and the 1-1 outlet pipe 120, and the 1-2 inlet pipe 130 and the 1-2 outlet pipe 140 may be positioned at different locations according to movement paths of a liquid and a refrigerant.

The first support structure 200 may support the first heat exchanger 10 on the base portion 90. For example, the first support structure 200 may include a 1-1 bracket 210 positioned on the first side 151 of the first heat exchanger 10, a 1-2 bracket 220 positioned on the second side 152 opposite to the first side 151, a 1-1 coupling portion 230 for fixing the 1-1 bracket 210 to the first side 151 and the base portion 90, and a 1-2 coupling portion 240 for fixing the 1-2 bracket 220 to the second side 152 and the base portion 90.

Referring to FIGS. 5, 6, 7A, and 7B, the 1-1 bracket 210 may include a 1-11 support plate 211 that is in a shape of a flat plate and is capable of being attached to the first side 151, and a 1-12 support plate 212 that is capable of being attached to the base portion 90. For example, the first side 151 of the first housing 150 may be vertical to the base portion 90. In this case, the 1-11 support plate 211 may be vertical to the 1-12 support plate 212. For example, the 1-11 support plate 211 and the 1-12 support plate 212 may be integrated into one body. The 1-1 inlet pipe 110 and the 1-1 outlet pipe 120 may be positioned at the first side 151. In this case, the 1-1 bracket 210 may include one or more grooves 213 through which the 1-1 inlet pipe 110 or the 1-1 outlet pipe 120 passes, not to interfere with the 1-1 inlet pipe 110 and the 1-1 outlet pipe 120.

The 1-2 bracket 220 may include a 1-21 support plate 221 that is in a shape of a flat plate and is capable of being attached to the second side surface 152, and a 1-22 support plate 222 that is capable of being supported on the base portion 90. For example, the second side 152 of the first housing 150 may be vertical to the base portion 90. In this case, the 1-21 support plate 221 may be vertical to the 1-22 support plate 222. For example, the 1-21 support plate 221 and the 1-22 support plate 222 may be integrated into one body. Also, the 1-2 inlet pipe 130 and the 1-2 outlet pipe 140 may be positioned at the second side 152. In this case, the 1-2 bracket 220 may include one or more grooves 223 through which the 1-2 inlet pipe 130 and the 1-2 outlet pipe 140 pass, not to interfere with the 1-2 inlet pipe 130 and the 1-2 outlet pipe 140.

The 1-1 coupling portion 230 may include a 1-11 coupling member 231 for fixing the 1-1 bracket 210 to the first side 151 of the first housing 150, and a 1-12 coupling member 232 for fixing the 1-1 bracket 210 to the base portion 90. For example, the 1-11 coupling member 231 may be a coupling member capable of fixing the 1-11 support plate 211 to the first side 151. The 1-12 coupling member 232 may be a coupling member capable of fixing the 1-12 support plate 212 to the base portion 90. According to an example, the 1-11 coupling member 231 and the 1-12 coupling member 232 may include one or more among a hook or a screw. However, the disclosure is not limited to this, and the 1-11 coupling member 231 and the 1-12 coupling member 232 may include another arbitrary coupling member other than a hook or a screw.

The 1-2 coupling portion 240 may include a 1-21 coupling member (e.g., including a fastener, hook, screw, or the like) 241 capable of fixing the 1-2 bracket 220 to the second side 152 of the first housing 150, and a 1-22 coupling member 242 capable of fixing the 1-2 bracket 220 to the base portion 90. For example, the 1-21 coupling member 241 may be a coupling member capable of fixing the 1-21 support plate 221 to the second side 152. The 1-22 coupling member 242 may be a coupling member capable of fixing the 1-22 support plate 222 to the base portion 90. According to an example, the 1-21 coupling member 241 and the 1-22 coupling member 242 may include one or more among a hook or a screw. However, the disclosure is not limited to this, and the 1-21 coupling member 241 and the 1-22 coupling member 242 may include another arbitrary coupling member other than a hook or a screw.

Referring again to FIGS. 4, 5 and 6, the compressor 30 may provide a force by which a refrigerant moves in a circulation cycle by sucking-in a low-pressure refrigerant and discharging a high-pressure refrigerant. A lower surface 31 of the compressor 30 according to an example may be supported on the base portion 90. To compress a refrigerant with high pressure, vibrations may be generated in the compressor 30. The vibrations generated in the compressor 30 may be transferred to other components, for example, the first heat exchanger 10 and the subcooler 40 through the base portion 90 on which the compressor 30 is supported.

The subcooler 40 may subcool a condensed refrigerant as described above. The subcooler 40 according to an example may be a plate (flat plate) type heat exchanger, like the first heat exchanger 10. For example, the subcooler 40 may include a second housing 450 that is in a shape of a rectangular parallelepiped capable of accommodating stacked heat transfer plates (not shown). However, the disclosure is not limited to this, and the second housing 450 may have an arbitrary shape depending on a shape of a heat transfer plate accommodated therein.

For example, the subcooler 40 may be a heat exchanger that exchanges heat between a refrigerant and an additional refrigerant for cooling the refrigerant. For example, the subcooler 40 may include a 2-1 inlet pipe 410 and a 2-1 outlet pipe 420 through which the refrigerant flows in and out. The subcooler 40 may include a 2-2 inlet pipe 430 and a 2-2 outlet pipe 440 through which the additional refrigerant flows in and out. For example, the 2-1 inlet pipe 410 and the 2-2 outlet pipe 420, and the 2-2 inlet pipe 430 and the 2-2 outlet pipe 440 may be positioned at the first side 451. However, the disclosure is not limited to this, and the 2-1 inlet pipe 410 and the 2-1 outlet pipe 420, and the 2-2 inlet pipe 430 and the 2-2 outlet pipe 440 may be positioned at different locations according to movement paths of the refrigerant and the additional refrigerant.

As described above, the subcooler 40 may be to subcool a condensed refrigerant before the refrigerant enters the expander 50. As shown in FIG. 2, the subcooler 40 may be positioned adjacent to the expander 50 to prevent/avoid the refrigerant pipe 15 from extending to an excessive length.

For example, the subcooler 40 may be spaced a preset distance h from the base portion 90, without being supported directly on the base portion 90. Because the subcooler 40 is not supported directly on the based portion 90, a vibration attenuation effect by a mass of the subcooler 40 may be not obtained. To obtain a vibration attenuation effect by the mass of the subcooler 40, the subcooler 40 may be supported on a side of the first heat exchanger 10. However, the disclosure is not limited to this, and the subcooler 40 may be supported at an arbitrary location of the first heat exchanger 10 capable of obtaining a vibration attenuation effect by the mass of the subcooler 40.

According to an example, the subcooler 40 may be supported on the first side 151 provided in the first heat exchanger 10 and another side, for example, a third side 153 that is vertical to the second side 152. Because the subcooler 40 is supported on the third side 153, the subcooler 40 may be prevented/inhibited from interfering with the 1-1 inlet pipe 110 and the 1-1 outlet pipe 120, and the 1-2 inlet pipe 130 and the 1-2 outlet pipe 140, supported on the first side 151 and the second side 152.

Referring to FIGS. 5, 6, 8, and 9, the second support structure 300 may support the subcooler 40 on the first heat exchanger 10. The second support structure 300 according to an example may be coupled to the first support structure 200 by connecting to the first support structure 200 to support the subcooler 40 on the first heat exchanger 10. For example, the second support structure 300 may include a second bracket 310 supporting one or more surfaces of the subcooler 40, a 2-1 coupling portion 320 fixing the 1-1 bracket 210 to an end of the second bracket 310, a 2-2 coupling portion 330 fixing the 1-2 bracket 220 to another end of the second bracket 310, and a 2-3 coupling portion 340 fixing the second bracket 310 to a surface of the subcooler 40.

The second bracket 310 may include a 2-1 support plate 311 provided in a shape of a flat plate to be supported on a surface of the subcooler 40, a 2-2 support plate 312 of which an end is coupled to the 1-1 bracket 210 and another end is fixed to the 2-1 support plate 311, and a 2-3 support plate 313 of which an end is coupled to the 1-2 bracket 220 and another end is fixed to the 2-1 support plate 311.

For example, the 2-1 support plate 311 may be supported on one surface of the subcooler 40. In this case, the 2-1 support plate 311 may be positioned between the 2-1 inlet pipe 410 and the 2-1 outlet pipe 420 and the 2-2 inlet pipe 430 and the 2-2 outlet pipe 440 to be prevented/inhibited from interfering with the 2-1 inlet pipe 410, the 2-1 outlet pipe 420, the 2-2 inlet pipe 430, and the 2-2 outlet pipe 440.

For example, the subcooler 40 may have a preset thickness, and the 2-2 support plate 312 may be connected to the 2-1 support plate 311 while forming a preset angle with respect to the 2-1 support plate 311. Also, the 2-3 support plate 313 may be connected to the 2-1 support plate 311 while forming a preset angle with respect to the 2-1 support plate 311. In this case, the 2-2 support plate 312 may be symmetrical to the 2-3 support plate 313 with the 2-1 support plate 311 in between. However, the disclosure is not limited to this, and an arbitrary connection structure capable of supporting the 2-1 support plate 311 supporting one surface of the subcooler 40 on the 1-1 bracket 210 and the 1-2 bracket 220, instead of the 2-2 support plate 312 and the 2-3 support plate 313, may be positioned.

The 2-1 coupling portion 320 may fix the 1-1 bracket 210 to an end portion of the second bracket 310. For example, the 2-1 coupling portion 320 may be a coupling member capable of coupling an end portion of the 2-2 support plate 312 to the 1-1 bracket 210 in such a way as to be fixed to the 1-1 bracket 210. The 2-1 coupling portion 320 according to an example may be one or more among a hook or a screw. However, the disclosure is not limited to this, and the 2-1 coupling portion 320 may include another arbitrary coupling member other than a hook or a screw.

The 2-2 coupling portion 330 may fix the 1-2 bracket 220 to another end portion of the second bracket 310. For example, the 2-2 coupling portion 330 may be a coupling member capable of coupling an end portion of the 2-3 support plate 313 to the 1-2 bracket 220 in such a way as to be fixed to the 1-2 bracket 220. The 2-2 coupling portion 330 according to an example may include one or more among a hook or a screw. However, the disclosure is not limited to this, and the 2-2 coupling portion 330 may include another arbitrary coupling member other than a hook or a screw.

The 2-3 coupling portion 340 may fix the second bracket 310 to a surface of the subcooler 40. For example, the 2-3 coupling portion 340 may be a coupling member capable of coupling the 2-1 support plate 311 to a surface of the subcooler 40 in such a way as to be fixed to the surface of the subcooler 40. The 2-3 coupling portion 340 according to an example may include one or more among a hook or a screw. However, the disclosure is not limited to this, and the 2-3 coupling portion 340 may include another arbitrary coupling member other than a hook or a screw.

The second support structure 300 according to an example may further include a connection member 350 positioned between the second bracket 310 and the base portion 90 and connecting the second bracket 310 to the base portion 90. As described above, the second bracket 310 may be connected to a first bracket 310 and supported by the first bracket 310. In addition, the connection member 350 may be positioned between the second bracket 310 and the base portion 90 to additionally support the second bracket 310 on the base portion 90. However, the disclosure is not limited to this, and the connection member 350 positioned between the second bracket 310 and the base portion 90 may be omitted.

Figure 10:
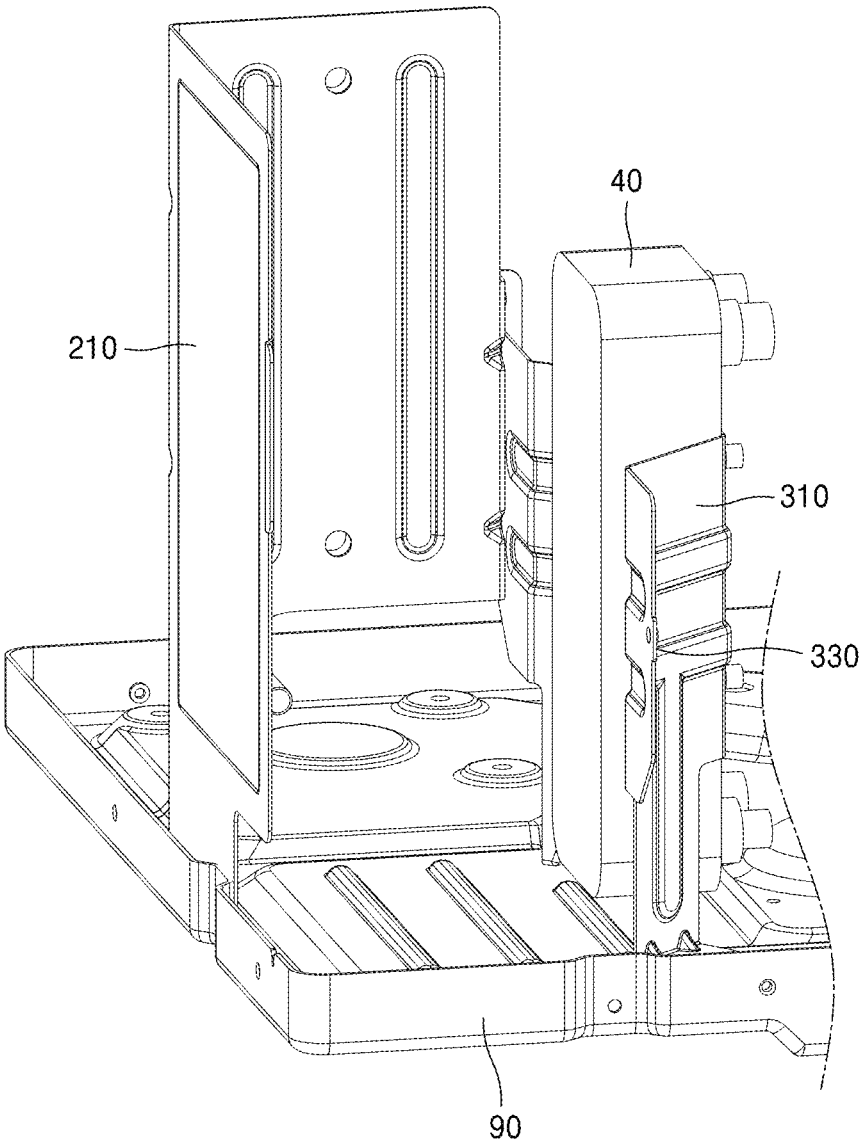
FIG. 10 is a perspective view of a heat exchanger assembly from which a first heat exchanger is separated, according to various embodiments.

FIG. 10 is a perspective view of a heat exchanger assembly from which a first heat exchanger is separated, according to various embodiments.

Referring to FIGS. 5, 7B, and 10, the first heat exchanger 10 according to an example may be independently separated from the base portion 90. For example, the 1-2 bracket 220 supporting the second side 152 of the first heat exchanger 10 may be supported on the base portion 90 in such a way as to be detachable from the base portion 90. In this case, the 1-1 bracket 210 may be supported on the base portion 90 in such a way as to be fixed with respect to the base portion 90. For example, while the first heat exchanger 10 is separated from the base portion 90, the 1-22 coupling member 242 fixing the 1-2 bracket 220 to the base portion 90 may be released to separate the 1-2 bracket 220 from the base portion 90. Also, the 2-2 coupling portion 330 fixing the 1-2 bracket 220 to the other end portion of the second bracket 310 may be released to separate the 1-2 bracket 220 from the other end portion of the second bracket 310.

As a result of separating the 1-2 bracket 220 from the base portion 90 and the second bracket 310, the first heat exchanger 10 may be separated from the base portion 90. The subcooler 40 may be positioned on the first side 151 on which the 1-1 bracket 210 and the 1-2 bracket 220 are positioned, and the third side 152 that is vertical to the second side 152. Accordingly, the first heat exchanger 10 may be independently separated along a side on which the 1-2 bracket 220 is positioned, without interfering with the subcooler 40. The subcooler 40 may be supported on the base portion 90 by the second bracket 310 and the 1-1 bracket 210.

As described above, the first heat exchanger 10 according to an example may be independently separated from the base portion 90. The subcooler 40 supported on a side of the first heat exchanger 10 may be supported on the base portion 90 regardless of whether the first heat exchanger 10 has been separated. Accordingly, when the first heat exchanger 10 needs to be repaired or replaced, the first heat exchanger 10 may be independently separated and replaced, which improves ease of use.

Figure 11:
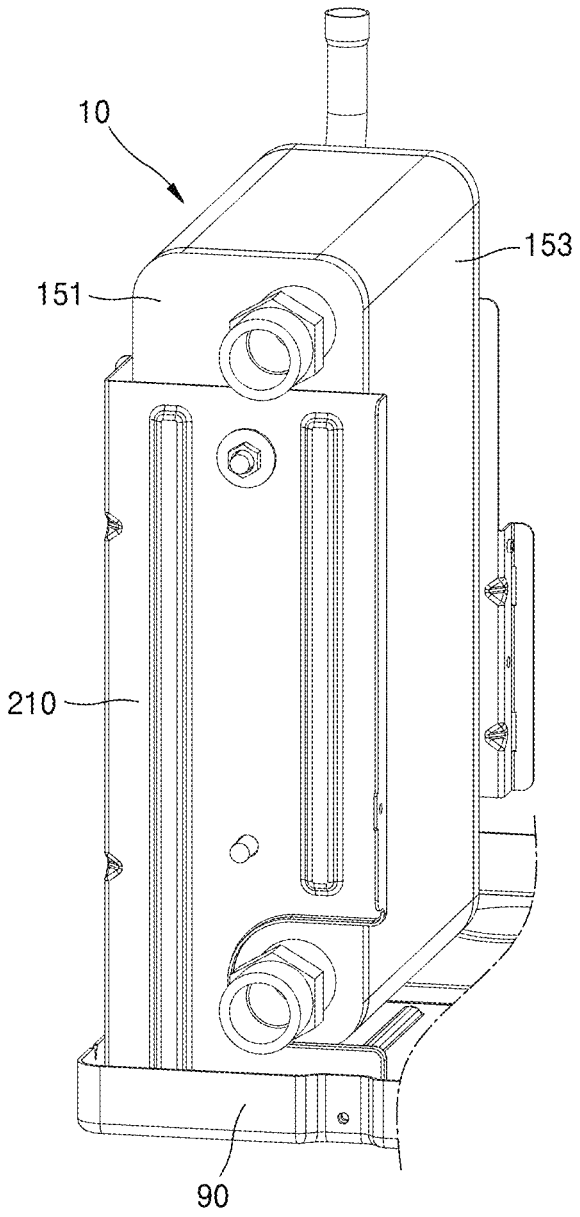
FIG. 11 is a perspective view of a heat exchanger assembly from which a subcooler is separated, according to various embodiments.

FIG. 11 is a perspective view of a heat exchanger assembly from which a subcooler is separated, according to various embodiments.

Referring to FIGS. 8, 9, and 11, the subcooler 40 according to an example may be independently separated from the base portion 90. For example, the second bracket 310 supporting the subcooler 40 may be supported on the 1-1 bracket 210 and the 1-2 bracket 220 in such a way as to be detachable from the 1-1 bracket 210 and the 1-2 bracket 220. In this case, the 1-1 bracket 210 and the 1-2 bracket 220 may be supported on the base portion 90 in such a way as to be fixed with respect to the base portion 90. For example, while the subcooler 40 is separated from the base portion 90, the 2-1 coupling portion 320 fixing one end of the second bracket 310 to the 1-1 bracket 210 may be released. The 2-2 coupling portion 330 fixing another end of the second bracket 310 to the 1-2 bracket 220 may be released. As a result of releasing of the 2-1 coupling portion 320 and the 2-2 coupling portion 330, the second bracket 210 may be separated from the 1-1 bracket 210 and the 1-2 bracket 220.

According to separating of the second bracket 310 from the 1-1 bracket 210 and the 1-2 bracket 220, the subcooler 40 may be separated from the first heat exchanger 10. The subcooler 40 may be positioned on the first side 151 on which the 1-1 bracket 210 and the 1-2 bracket 220 are positioned, and the third side 153 that is vertical to the second side 152. Accordingly, the subcooler 40 may be independently separated along one side on which the second bracket 310 is positioned, without interfering with the first heat exchanger 10. The first heat exchanger 10 may be supported on the base portion 90 by the 1-1 bracket 210 and the 1-2 bracket 220.

As described above, the subcooler 40 according to an example may be independently separated from the first heat exchanger 10. The first heat exchanger 10 may be supported on the base portion 90 regardless of whether the subcooler 40 has been separated. Accordingly, when the subcooler 40 needs to be repaired or replaced, the subcooler 40 may be independently separated and replaced, which improves ease of use.

While the disclosure has been illustrated and described with reference to various example embodiments, it will be understood that the various example embodiments are intended to be illustrative, not limiting. It will be further understood by those skilled in that art that various modifications and other equivalent embodiments may be made from the above-described embodiments without departing from the true spirit and full scope of the disclosure, including the appended claims and their equivalents. It will also be understood that any of the embodiment(s) described herein may be used in conjunction with any other embodiment(s) described herein.

What is claimed is:

1. A heat exchanger assembly comprising:

a compressor configured to compress a refrigerant;

a first heat exchanger configured to exchange heat between the refrigerant and a liquid;

a subcooler configured to subcool the refrigerant;

a base supporting the compressor and the first heat exchanger, a first support structure supported on the base and comprising a support supporting the first heat exchanger; and a second support structure comprising a support supporting the subcooler on the first heat exchanger;

wherein the subcooler is supported on a side of the first heat exchanger;

wherein the second support structure is connected to the first support structure, wherein the first support structure comprises:

a first first bracket supported on a first side of the first heat exchanger; and a second first bracket supported on a second side opposite to the first side;

wherein the second support structure comprises a second bracket supporting one or more surfaces of the subcooler; and wherein one end of the second bracket is supported by the first first bracket and the other end of the second bracket is supported by the second first bracket.

2. The heat exchanger assembly of claim 1, wherein the first support structure comprises:

a first first coupling portion configured to fix the first first bracket to the first side and the base;

and a second first coupling portion configured to fix the second first bracket to the second side and the base, and the second support structure comprises:

a first second coupling portion configured to fix the first first bracket to an end portion of the second bracket; and a second second coupling portion configured to fix the second first bracket to another end portion of the second bracket.

3. The heat exchanger assembly of claim 1, wherein the second first bracket is supported on the base and is configured to be detachable from the base.

4. The heat exchanger assembly of claim 1, wherein the subcooler is supported on the first side and another side vertical to the first side.

5. The heat exchanger assembly of claim 1, wherein the second bracket is supported on the first first bracket and the second first bracket and is configured to be detachable from the first first bracket and the second first bracket.

6. The heat exchanger assembly of claim 1, wherein the subcooler is spaced a specified distance from the base.

7. An outdoor unit including a heat exchanger assembly, the heat exchanger assembly comprising:

a compressor configured to compress a refrigerant;

a first heat exchanger configured to exchange heat between the refrigerant and a liquid;

a second heat exchanger configured to exchange heat between the refrigerant and air or a liquid;

a subcooler configured to subcool the refrigerant;

one or more expanders configured to expand the refrigerant transferred through the subcooler;

a base supporting the compressor and the first heat exchanger;

a first support structure supported on the base and comprising a support supporting the first heat exchanger; and a second support structure comprising a support supporting the subcooler on the first heat exchanger;

wherein the subcooler is supported on a side of the first heat exchanger;

wherein the second support structure is connected to the first support structure, wherein the first support structure comprises:

a first first bracket supported on a first side of the first heat exchanger; and a second first bracket supported on a second side opposite to the first side;

wherein the second support structure comprises:

a second bracket supporting one or more surfaces of the subcooler; and wherein one end of the second bracket is supported by the first first bracket and the other end of the second bracket is supported by the second first bracket.

8. The outdoor unit of claim 7, wherein the first support structure comprises:

a first first coupling portion configured to fix the first first bracket to the first side and the base; and a second first coupling portion configured to fix the second first bracket to the second side and the base, and the second support structure comprises:

a first second coupling portion configured to fix the first first bracket to an end portion of the second bracket; and a second second coupling portion configured to fix the second first bracket to another end portion of the second bracket.

9. The outdoor unit of claim 7, wherein the second first bracket is supported on the base and is configured to be detachable from the base.

10. The outdoor unit of claim 7, wherein the subcooler is supported on the first side and another side vertical to the first side.

11. The outdoor unit of claim 7, wherein the second bracket is supported on the first first bracket and the second first bracket and is configured to be detachable from the first first bracket and the second first bracket.

* * * * *